United States Patent [19]

Gerhard

[11] Patent Number: 4,629,085

[45] Date of Patent: Dec. 16, 1986

[54] FRAME STRUCTURE FOR ACCOMMODATING A PLURALITY OF CONTAINERS

[75] Inventor: Helmut Gerhard, Weitefeld, Fed. Rep. of Germany

[73] Assignee: Westerwaelder Eisenwerk Gerhard, Weitefeld, Fed. Rep. of Germany

[21] Appl. No.: 692,984

[22] Filed: Jan. 22, 1985

[30] Foreign Application Priority Data

Jan. 23, 1984 [DE] Fed. Rep. of Germany ... 8401788[U]

[51] Int. Cl.[4] ..... B60P 7/13; B65D 19/44; B65D 25/10

[52] U.S. Cl. ..... 220/1.5; 108/55.3; 220/401; 248/310; 248/316.1; 248/500; 296/35.3; 410/81

[58] Field of Search ..... 220/401, 1.5, 23.4; 108/55.3, 55.5; 410/33, 42, 48, 77, 78, 79, 80, 81, 133, 132, 139, 142, 90, 152, 68, 89, 91; 248/310, 316.1, 316.2, 316.6, 231.9, 354.5, 500, 503, 675, 677, 680; 296/35.1, 35.3

[56] References Cited

U.S. PATENT DOCUMENTS

| | | | |
|---|---|---|---|
| 922,293 | 5/1909 | Kirchner | 410/78 |
| 1,414,516 | 5/1922 | Kirchner | 410/77 |
| 1,649,598 | 11/1927 | Kirchner | 410/79 |
| 2,165,652 | 7/1939 | Reifer et al. | 410/152 |
| 2,790,111 | 4/1957 | Calling | 248/500 X |
| 3,125,177 | 3/1964 | Paller | 248/503 X |
| 3,125,965 | 3/1964 | De Penti et al. | 410/81 X |
| 3,159,111 | 12/1964 | Gutridge et al. | 410/79 |
| 3,237,786 | 3/1966 | Milliken | 410/42 |
| 3,271,089 | 9/1966 | Krellen | 220/1.5 X |
| 3,285,204 | 11/1966 | Schweitzer, Jr. | 108/55.3 |
| 3,319,583 | 5/1967 | Gutridge | 410/81 |
| 3,386,600 | 6/1968 | Betjemann | 220/1.5 X |
| 3,459,326 | 8/1969 | Betjemann | 220/1.5 |
| 3,695,471 | 10/1972 | Rivers, Jr. | 220/23.4 |
| 4,078,836 | 3/1978 | Wilson | 410/152 X |
| 4,266,820 | 5/1981 | Whaley et al. | 296/35.3 |
| 4,382,735 | 5/1983 | Synowiec | 410/80 X |

FOREIGN PATENT DOCUMENTS

| | | | |
|---|---|---|---|
| 703841 | 3/1941 | Fed. Rep. of Germany | 410/90 |

*Primary Examiner*—Allan N. Shoap
*Attorney, Agent, or Firm*—Barnes & Thornburg

[57] ABSTRACT

A frame structure serves to accommodate a plurality of non-standardized small tanks or containers to form a transport unit of standard overall dimensions. The small containers are of the type having foot portions formed with channels or openings for receiving fork lift arms. The frame structure includes a bottom group with a plurality of parallel struts extending in one direction and a number of further frame members extending in the other direction. These struts and frame members form windows for receiving the foot portions of the small containers. Locking members are provided which engage the channels formed in the foot portions of the small containers for coupling these to the frame structure.

13 Claims, 6 Drawing Figures

FIG. 1
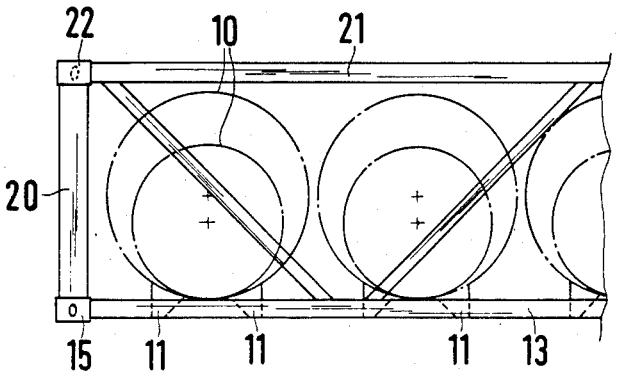
FIG. 6
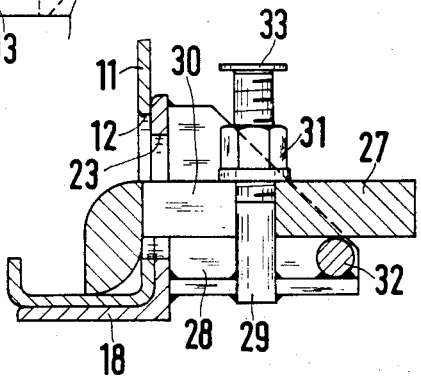
FIG. 3
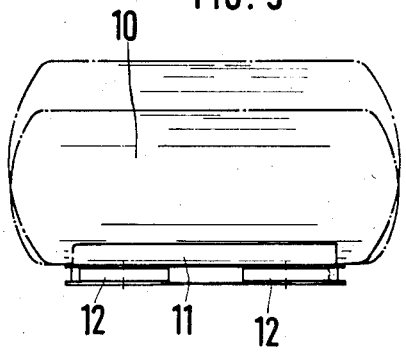
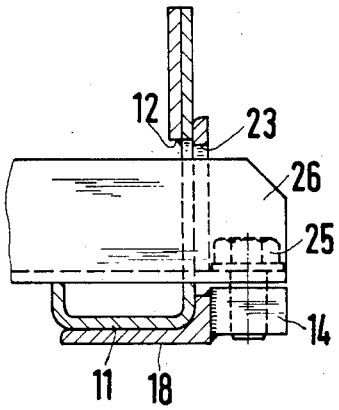
FIG. 4
FIG. 5
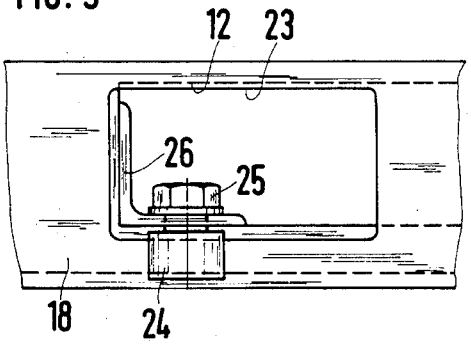

FRAME STRUCTURE FOR ACCOMMODATING A PLURALITY OF CONTAINERS

DESCRIPTION

The invention relates to a frame structure for accommodating a plurality of containers, each of which has a foot portion formed with channels for receiving fork lift arms, to form a transport unit.

The containers are, in particular, non-standardized small tanks or containers. When seceral such containers are combined to form a transport unit of standard overall dimensions, it is necessary to couple the individual containers with the frame structure in such a manner that the coupling requires only a minimum of structural modifications and/or additional measures for each container. Also, such a coupling should be readily made and released, and should ensure a highly secure and rigid connection.

To meet with this object, the frame structure of the present invention includes a bottom group with parallel extending struts, pairs of which define lateral boundaries of windows for receiving the foot portions of the containers, and locking means for engagement in the channels or openings formed in said foot portions. These channels or openings are thus used for locking engagement with corresponding structural parts of the frame structure. Since the foot portion of this type of container extends over a substantial part of the container length and also substantially defines the width of the container, and since the channels are provided at those locations where the load of each individual container is most favourably transferred to the respective supporting elements, such as the fork lift arms, use of these channels results in a reliable anchoring.

In a preferred embodiment, each anchoring element comprises an L-shaped clamp having one leg adapted to engage in the respective channel and the other leg to be clamped to a respective strut by means of a screw. In this embodiment, the individual anchoring element requires little space and is therefore easily manipulated.

In another preferred embodiment, the anchoring elements are formed as bars adapted to pass through both struts defining a window and are adapted to be clamped to fastening elements mounted on the outer sides of these struts. A particularly inexpensive, yet stable design of the anchoring element is thus provided. In this case, it is further preferable that the channels formed in the foot portions of the containers and cut-outs formed in the struts of the frame structure have at least twice the width of said bars, and that the fastening elements are disposed at that end of each cut-out which is adjacent the outside of the frame structure. This concept permits every individual container to be detached from the frame structure without problems, even in case of a highly compact container arrangement.

In a further preferable embodiment of the invention, guide plates extending obliquely upwardly and outwardly are provided at the corners of each window formed in the frame structure. These guide plates facilitate the placing of the individual container into the frame structure.

The frame structure may be formed as a non-stackable platform of standard length and width with four lower corner fittings, or alternatively as a frame-type container, again with standard length, width and height, which surrounds the small containers on all sides and is provided with four upper and four lower corner fittings.

Further details of the invention will now be explained with reference to the accompaning drawings, in which FIG. 1 is a fragmentary side view of a frame designed as a frame-type container in which a plurality of small containers are placed, two different diameters being indicated for the small containers;

FIG. 3 is a side view of a single small container, two different diameters being again indicated;

FIG. 4 is a fragmentary sectional view through a strut of the frame and a foot member of the small container placed in the frame, the foot member including a part of an anchoring element;

FIG. 5 is a side view of the arrangement shown in FIG. 4; and

FIG. 6 is a view similar to FIG. 4, but showing another embodiment of an anchoring element.

Figure 2:
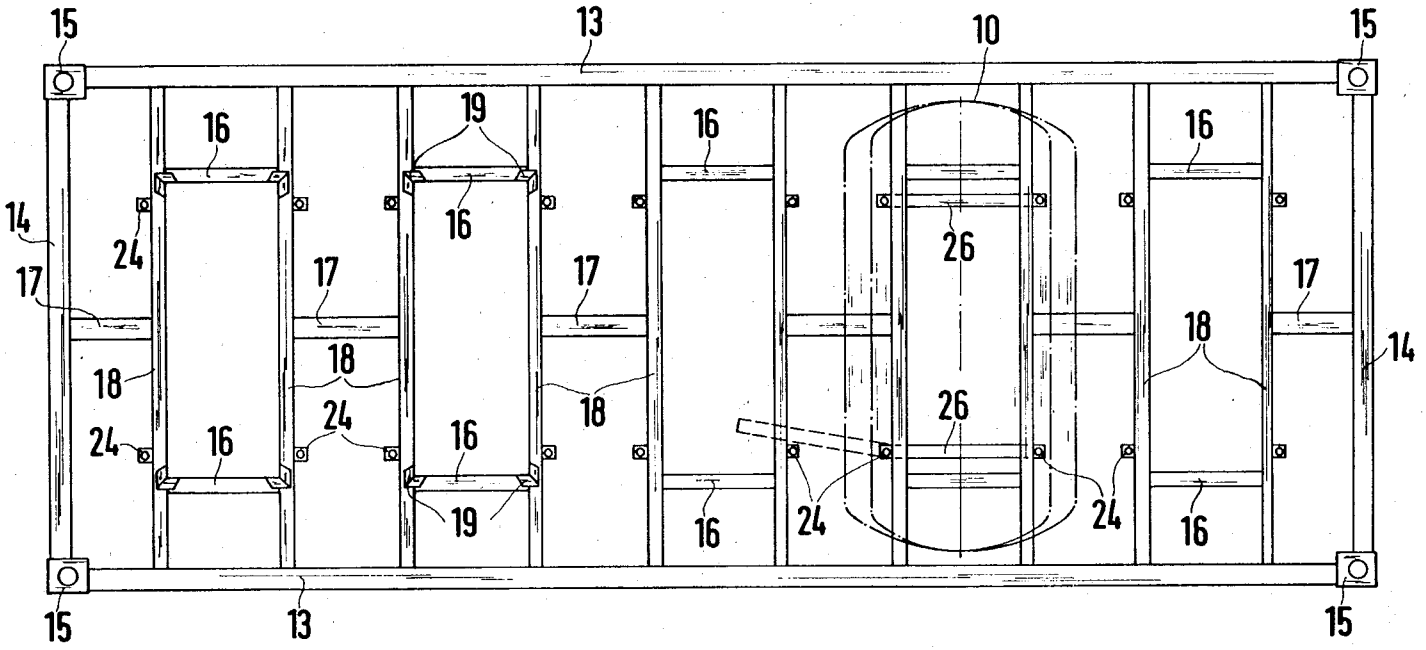
FIG. 2 is a plan view of the frame shown in FIG. 1 with only one small container placed therein.

As will be apparent from FIGS. 1 and 3, each of the small containers 10, which are to be combined to constitute a transport unit, is shaped as a generally cylindrical tank provided at the bottom surface thereof with two foot members 11 extending in the longitudinal direction of the container. The foot members 11 define a rectangular bottom surface irrespective of the container diameter. As shown in FIG. 3, the foot members are formed with two fork lift channels or openings 12 by means of which every small container may be manipulated. The channels or openings 12 are provided in the regions that constitute the load adsorbing regions prescribed by the pertinent ISO standards.

As shown in FIG. 2, the frame is constituted by outer pairs of horizontally extending side members 13 and by cross members 14 joined to each other at the corners of the frame by means of standardized corner fittings 15. Couples of cross struts 18 are inserted between the two side members 13, the clearance between said cross struts being somewhat larger than the width of the bottom surface of the small containers 10 as defined by the foot members 11. For stiffening purposes, the couples of cross struts 18 are joined to each other and to the cross members 14 through central members 17. Moreover, between the cross struts 18, there are mounted couples of longitudinal struts 16 whose clearance is somewhat larger than the length of the foot members 11 of the small containers. Respective pairs of longitudinal struts 16 and cross struts 18 cooperate to form frame- or trough-like windows for receiving the foot members 11 of individual small containers 10. In order to facilitate lowering of the small containers 10 with their foot members 11 into said windows, bent guide plates 19 each extending obliquely upwardly and outwardly are provided at the junctures between the longitudinal struts 16 and the cross struts 18.

According to a modification (not shown), it is also possible to use two longitudinal struts extending between the two cross members 13 and to insert between these longitudinal struts respective pairs of cross struts so as to form the mentioned trough-like windows for receiving the small containers.

FIG. 2 shows the bottom group of the frame, which may readily be used as an open-topped and open-sided platform for the transport of a plurality of small containers. As shown in FIG. 1, this bottom group may, however, also be completed by four corner posts 20 and upper side members 21, cross members and further corner fittings 22 to form a stackable frame-type container which surrounds the small containers on all sides.

In all of these cases the frame constitutes an auxiliary structure which is used as a dimensional bridge between non-standardized small containers and external dimensions (20 and 40 feet) fitting into the worldwide ISO container system (as used in cellular container ships, road and rail vehicles).

As will be particularly apparent from FIGS. 4 and 6, the cross struts 18 are L-section rails on whose lower horizontal leg the respective foot member 11 of the small container rests. Each vertical leg of these cross struts 18 is provided with two cut-outs 23 which, when the small container has been inserted, are at least partially in alignment with the fork lift channels 12 in the container foot members 11.

As shown in FIGS. 4, 5, and 2, the outer sides of the cross struts 18 in the vicinity of the cut-outs 23 are respectively provided with nuts or eyes 24 formed with a threaded bore for accommodating a screw bolt 25. Two anchoring elements 26 are employed to anchor the foot members 11 of a small container 10 in one of the receiving windows defined by the longitudinal struts 16 and cross struts 18, said anchoring elements 26 according to FIG. 5 being L-section rails extending through cut-outs 23 in the cooperating couple of cross struts 18 and through the channels or fork lift openings 12 in both foot members 11 of the respective small container 10; the two ends of each anchoring element are secured to the eyes 24 via respective screw bolts 25.

As will be apparent from FIG. 4, the cut-outs 23 in the cross struts 18 are designed relative to the channels or fork lift openings 12 in the foot members 11 of the small containers 10 in such a way and the nuts or eyes 24 are mounted in such a way that upon tightening of the screw bolts 25 a tensioning of the small containers relative to the frame is achieved.

FIG. 5 also shows that the cut-outs 23 have more than twice the width of the horizontally extending legs of the L-shaped anchoring elements 26. This permits an anchoring element 26, when being pulled out of its anchoring position, to enter partially into the cut-out of an adjacent cross strut 18, as indicated in FIG. 2. For the desired compact arrangement of the small containers 10 within the frame, this in turn permits the anchoring elements 26 extending through the two foot members 11 to be displaced to a sufficient extent so that every small container may be individually removed from its anchored position.

Instead of the L-section rails shown in FIGS. 4 and 5 it is also possible to employ horizontal or upright U-section rails or closed box-section rails as the anchoring elements.

In the modification shown in FIG. 6, the anchoring elements consist of individual L-shaped clamps 27 each of which penetrates into a foot member 11 only through the cut-out 23 of a cross strut 18 and into the fork lift channel 12 of the foot member. A supporting bracket 28 mounted on the cross strut 18 carries a threaded bolt 29 projecting through a longitudinal slot 30 formed in the clamp 27. In the braced condition a nut 31 bears against the clamp 27 such that the bent-down inner leg thereof bears against the lower inner face of the foot member 11 while the outer leg rests on an abutment member 32 of the bracket 28. A disk 33 mounted on the top end of the threaded bolt 29 holds the nut 31 captive.

What is claimed is:

1. A frame structure for a plurality of containers, each container having foot portions formed with fork lift openings thereon, said frame structure including:

a bottom frame section having a plurality of parallel extending struts, pairs of said struts defining lateral boundary supports for receiving said foot portions of said containers, at least some of said struts having cut-out portions therethrough, and locking means including anchoring elements adapted to be passed through respective ones of said cut-outs formed in the struts and through respective ones of said fork lift openings for engagement with said foot portions, wherein said anchoring elements are formed as bars adapted to pass through said struts forming said lateral boundary supports to engage the foot portions on one side of the struts and be secured in place at a location adjacent said struts.

2. The frame structure of claim 1, wherein said bars are adapted to be clamped to fastening elements mounted on the outer sides of said pairs of struts.

3. The frame structure of claim 2, wherein said openings formed in the foot portions of the containers and said cut-outs formed in the struts have at least twice the width of said bars, said fastening elements being disposed at that end of each cut-out which is adjacent the outside of the frame structure.

4. The frame structure of claim 1, further including at least one pair of parallel frame members extending transversely to said struts.

5. The frame structure of claim 1, wherein guide plates extending obliquely upwardly and outwardly are provided on said struts.

6. The frame structure of claim 1, formed as a platform and provided with four lower corner fittings.

7. The frame structure of claim 1, formed as a frame-type container and provided with four upper and four lower corner fittings.

8. A frame structure for a plurality of containers, each container having foot portions formed with fork lift openings, said frame structure including:

a bottom frame section having a plurality of parallel extending struts, pairs of said struts defininf lateral boundary supports for receiving said foot portions of said containers, at least some of said struts having cut-out portions therethrough, and locking means including anchoring elements adapted to be passed through respective ones of said cut-outs formed in the struts and through respective ones of said fork lift openings for engagement with said foot portions wherein said anchoring elements each comprise an L-shaped clamp having one leg adapted to pass through the respective cut-out and opening for lockingly engaging said leg with said foot portion, and the other leg to be clamped by a clamping means to a respective strut.

9. The frame structure of claim 8, further including at least one pair of parallel frame members extending transversely to said struts.

10. The frame structure of claim 8, wherein guide plates extending obliquely upwardly and outwardly are provided on said struts.

11. The frame structure of claim 8, formed as a platform and provided with four lower corner fittings.

12. The frame structure of claim 8, formed as a frame-type container and provided with four upper and four lower corner fittings.

13. The frame structure of claim 8, wherein said clamping means includes a threaded connecting means for threadably engaging the respective leg of said L-shaped clamp to said respective strut.

* * * * *